US008832948B2

(12) United States Patent
Sekiguchi et al.

(10) Patent No.: US 8,832,948 B2
(45) Date of Patent: Sep. 16, 2014

(54) MEDIUM PROCESSING DEVICE

(75) Inventors: Takahisa Sekiguchi, Nagano (JP); Takuya Maruo, Nagano (JP)

(73) Assignee: Mimaki Engineering Co., Ltd., Nagano (JP)

( * ) Notice: Subject to any disclaimer, the term of this patent is extended or adjusted under 35 U.S.C. 154(b) by 344 days.

(21) Appl. No.: 13/489,470

(22) Filed: Jun. 6, 2012

(65) Prior Publication Data

US 2012/0313319 A1 Dec. 13, 2012

(30) Foreign Application Priority Data

Jun. 10, 2011 (JP) ..... 2011-130185

(51) Int. Cl.

*B26D 5/20* (2006.01)
*B26D 5/02* (2006.01)
*B26F 1/38* (2006.01)

(52) U.S. Cl.

CPC ..... *B26F 1/3813* (2013.01); *B26D 5/02* (2013.01)
USPC ..... 33/18.1; 347/37

(58) Field of Classification Search

CPC ..... B26F 1/3813; B26F 1/3806; B26D 11/00; B26D 5/02; B26D 7/34; B26D 5/00; B41J 11/001; B41J 11/0015; B41J 11/003; B41J 11/663; B41J 11/706; B41J 19/005; B41J 3/543; B41J 11/36; B41J 15/04; B65H 20/02; B65H 20/24
USPC ..... 33/18.1, 18.2, 18.3, 614, 623; 347/37, 347/40; 118/35
See application file for complete search history.

(56) References Cited

U.S. PATENT DOCUMENTS

| | | | | |
|---|---|---|---|---|
| 6,112,630 | A * | 9/2000 | Miura | 83/76.6 |
| 7,789,484 | B2 * | 9/2010 | Takada et al. | 347/37 |
| 2008/0238996 | A1 * | 10/2008 | Takada et al. | 347/37 |
| 2012/0312228 | A1 * | 12/2012 | Sekiguchi et al. | 118/35 |
| 2012/0313319 | A1 * | 12/2012 | Sekiguchi et al. | 271/264 |

OTHER PUBLICATIONS http://www.graphtec.co.jp/site_cutting/gl/ce5000/spec.html, retrieved on Jun. 3, 2011, with English translation (http://www.graphtec.com/imaging/ce5000/ce5000_specs.html) thereof, "Cutting Plotter CE-5000".

* cited by examiner

*Primary Examiner* — Yaritza Guadalupe-McCall
(74) *Attorney, Agent, or Firm* — Jianq Chyun IP Office

(57) ABSTRACT

To provide a device that can execute both of two kinds of processes, at least, for a target medium inexpensively with high accuracy. A plotter 20 includes a cutter 1 and a pen 2 for individually executing each specific process for paper being transferred in a predetermined direction, and a receiving portion 8 for supporting the paper to be processed by the cutter 1 and the pen 2, while the receiving portion 8 being provided at a position facing the cutter 1 and the pen 2 through the intermediary of the paper. Then, the cutter 1 and the pen 2 are positioned on different lines individually in a direction intersecting the transfer direction of the paper. Therefore, a condition of the receiving portion 8 after a process by one tool does not affect the other tool.

5 Claims, 2 Drawing Sheets

MEDIUM PROCESSING DEVICE

CROSS-REFERENCE TO RELATED APPLICATIONS

This application claims the priority benefit of Japan application serial no. 2011-130185, filed on Jun. 10, 2011. The entirety of the above-mentioned patent application is hereby incorporated by reference herein and made a part of this specification.

FIELD OF THE INVENTION

The present invention relates to a medium processing device for executing a plurality of processes for a target medium.

BACKGROUND

A cutting plotter AC-800 (MUTOH INDUSTRIES LTD., Japan) disclosed in Non-patent Document 1 and a cutting plotter CE-5000 (GRAPHTEC CORPORATION, Japan) disclosed in Non-patent Document 2 are known as medium processing devices for executing processes; such as a drawing process, a cutting process, and the like; for a target sheet medium, such as a paper medium, and so on. In the cutting plotter AC-800 described in Non-patent Document 1, a pen and a cutter are provided at a position facing a rubber roller placed as a receiving portion, and a drawing process and a cutting process are executed while the rubber roller is rolling in synchronization with a roller for transferring a sheet. In the cutting plotter CE-5000 described in Non-patent Document 2, a flexible member made of napped material, which facilitates turning motion and following motion of a cutter, is used as a receiving portion for a process by using a pen and a cutter.

PRIOR ART DOCUMENTS

Non-Patent Documents

[Non-patent Document 1] "Cutting Plotter AC-800", (online), (searched on the internet on Jun. 3, 2011) <http://www.mutoh.co.jp/printer_plotter/~plotter/ac800/index.html>

[Non-patent Document 2] "Cutting Plotter CE-5000", (online), (searched on the internet on Jun. 3, 2011) <http://www.graphtec.co.jp/site_cutting/gl/ce5000/spec.html>

SUMMARY OF INVENTION

Problem to be Solved

In the devices disclosed in Non-patent Document 1 and Non-patent Document 2 mentioned above, a drawing tool or a cutting tool is installed on a carriage for executing at least two kinds of processes for a target medium. In those medium processing devices, a drawing process and a cutting process are executed for the target medium by means of pressing the drawing tool or the cutting tool against the target medium being transferred, while the target medium is transferred and the carriage is reciprocated in a direction intersecting a direction of the transfer. On this occasion, a receiving portion is placed at a position facing each of the drawing tool and the cutting tool, and then the process is supported by means of contacting motion of the receiving portion with each tool through the intermediary of the target medium.

If a rubber plate is simply placed as a receiving portion that works for both the drawing tool and the cutting tool in common, turning motion and following motion of a cutter are hindered. As a result, cutting accuracy becomes deteriorated due to hooking in cutting motion, a jump of the tool during cutting operation, and so on, and therefore durability of a blade of the cutter is lessened. Furthermore, when drawing operation is executed by using a pen on a rubber roller damaged by a cutter, drawing performance becomes deteriorated.

In the cutting plotter disclosed in Non-patent Document 1, a rubber roller is used as a receiving portion of each tool. Then, it is designed to remedy a problem of hindrance to turning motion and following motion of a cutter, by turning the rubber roller in synchronization with a transfer roller for a target medium. Unfortunately, even in such a case, no difference is made from a viewpoint of drawing operation by using a pen on the rubber roller damaged by the cutter, and therefore drawing performance becomes deteriorated. Furthermore, replacement of the rubber roller damaged by the cutter is needed, and unfortunately this leads to a cost increase.

Meanwhile, in the cutting plotter disclosed in Non-patent Document 2, a flexible napped material is used for a receiving portion, and therefore turning motion and following motion of a cutter are facilitated. Unfortunately, even in such a case, if used is a target medium made of thin material and the like, there come up unfavorable effects that deteriorate drawing accuracy; namely, drawing operation makes a hole in the target medium, the target medium is not transferred smoothly so as to eventually caused a jam, and so on.

As described above, in those conventional medium processing devices for drawing operation and cutting operation, it is difficult to execute both the drawing operation and the cutting operation with high accuracy; and desired is a device that enables both the drawing operation and the cutting operation with high accuracy, as a result of a remedy for the problem. Then, it is an object of the present invention to provide a device that can execute at least two kinds of processes for a target medium with high accuracy for both the processes.

Means to Solve the Problem

To bring a solution for the subject described above, a medium processing device according to the present invention includes: a first processing means and a second processing means for individually executing each specific process for a medium being transferred in a predetermined direction, while the first processing means and the second processing means being reciprocated in a direction intersecting the transfer direction of the medium; and a supporting means for supporting the medium to be processed by the first processing means and the second processing means, while the supporting means being provided at a position facing the first processing means and the second processing means through the intermediary of the medium; wherein the first processing means and the second processing means are positioned on different lines individually in the direction intersecting the transfer direction of the medium.

According to the above-described configuration, the first processing means and the second processing means are individually placed at an offset position on each specific line in the direction intersecting the transfer direction of the medium. Accordingly, the first processing means and the second processing means have no chance to pass through on the same line at the time of processing the medium while being reciprocated in the direction intersecting the transfer direction of the medium. Therefore, without being affected by a surface condition of the supporting means after one kind of processing, the other kind of processing can be executed. Thus, both the processes by using the first processing means as well as the second processing means can be executed with high accuracy.

Moreover, in the medium processing device according to the present invention, the supporting means may further includes a first supporting portion provided at a position facing the first processing means through the intermediary of the medium; and a second supporting portion provided at a position facing the second processing means through the intermediary of the medium.

According to the above-described configuration, the first supporting portion is provided as a supporting means for the first processing means, and the second supporting portion is provided as a supporting means for the second processing means; and thus each specific receiving portion can be provided for each of the first processing means and the second processing means. Therefore, selecting an appropriate material of the supporting means for each process makes it possible to execute the process with high accuracy. Furthermore, since an appropriate material of the supporting means for each process is selected, durability of each processing means as well as durability of the supporting means itself are improved so that replacement costs of these means can be reduced.

Furthermore, in the medium processing device according to the present invention, preferably one of the first processing means and the second processing means is a means for drawing on the medium, and the other is a means for cutting the medium.

According to the above-described configuration, equipped are both a drawing means for drawing on the medium and a cutting means for cutting the medium. Then, since these means are held by a holding means individually at each offset position, drawing operation by the drawing means, for example, is not affected by a surface condition of the supporting means after cutting operation by the cutting means. Therefore, both the drawing operation and the cutting operation can be executed with high accuracy.

Moreover, preferably the medium processing device according to the present invention further includes a holding means for holding the first processing means and the second processing means; and the holding means holds the first processing means and the second processing means in such a way that a distance of one processing means to the medium can interchangeably be made shorter and longer in comparison with a distance of the other processing means to the medium.

According to the above-described configuration; while two kinds of processing means being held collectively, one processing means for executing an objective process can be brought close to the medium for executing the process. Namely, it is not needed to change the processing means for each process, and the device does not need to stop operation for changing the processing means, so that the processing time can be shortened. Furthermore, since the distances of the processing means to the medium are changed by using one holding means, positions of the processing means in relation to the medium can easily be adjusted.

Furthermore, in the medium processing device according to the present invention, preferably the holding means holds either the first processing means or the second processing means, whichever has a greater pressing force against the medium, at a position closer to the carriage.

According to the above-described configuration; for example, in the case where the first processing means has a greater pressing force against the medium than the second processing means has, the holding means holds the first processing means and the second processing means in such a way that a distance of the first processing means to the holding means is shorter than a distance of the second processing means to the holding means. Thus, each processing means can have a pressing force as required for sure, and each process can be executed with high accuracy.

Advantageous Effect of the Invention

The medium processing device according to the present invention includes: a first processing means and a second processing means for individually executing each specific process for a medium being transferred in a predetermined direction, while the first processing means and the second processing means being reciprocated in a direction intersecting the transfer direction of the medium; and a supporting means for supporting the medium to be processed by the first processing means and the second processing means, while the supporting means being provided at a position facing the first processing means and the second processing means through the intermediary of the medium; wherein the first processing means and the second processing means are positioned on different lines individually in the direction intersecting the transfer direction of the medium. Therefore, a surface condition of the supporting means after one processing means executes its process does not affect the other processing means so that both the processes can be executed with high accuracy.

DESCRIPTION OF THE PREFERRED EMBODIMENT

Figure 1:
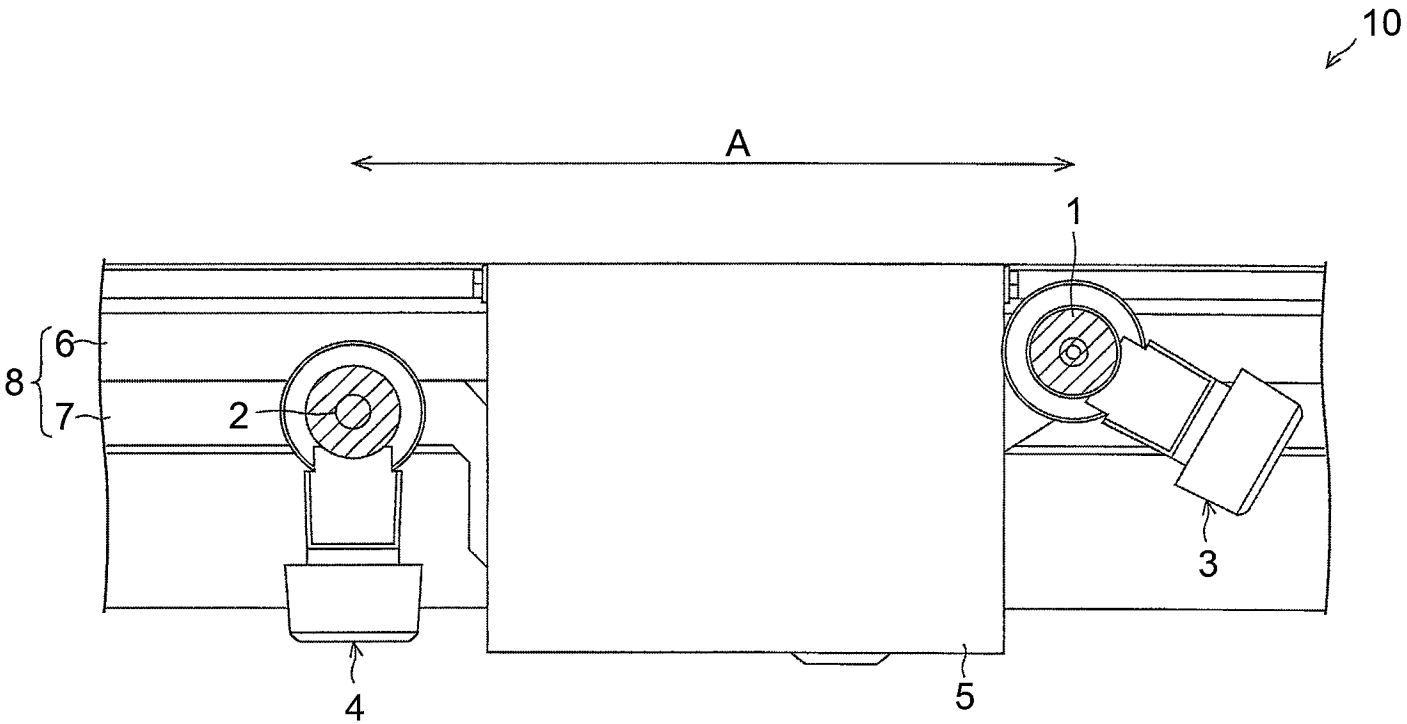
FIG. 1 is a schematic view showing a head portion of a plotter according to an embodiment of the present invention.
Figure 2:
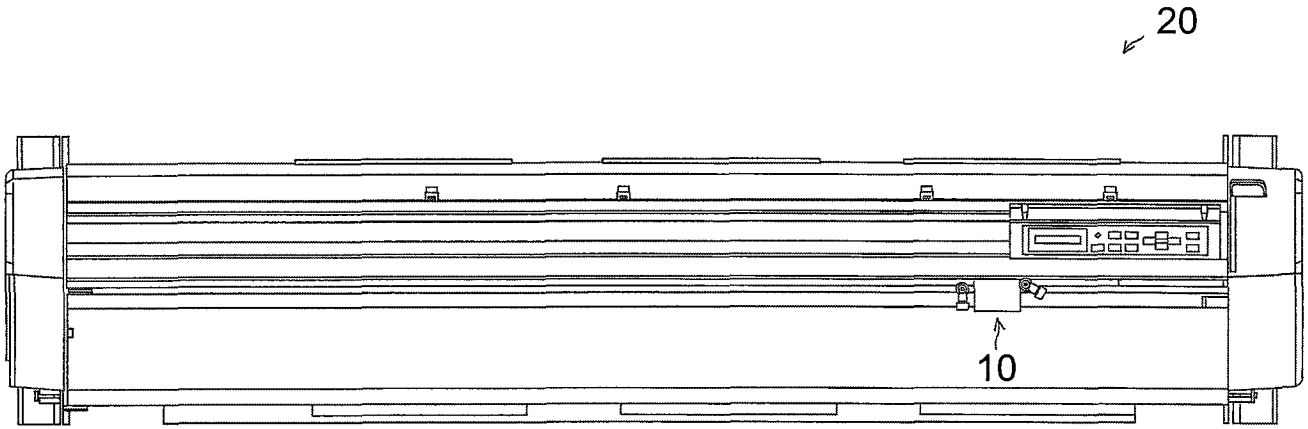
FIG. 2 is a schematic view showing the plotter according to the embodiment of the present invention.

A preferred embodiment according to the present invention is described below in detail with reference to FIG. 1 and FIG. 2. FIG. 1 is a schematic view showing a section of a head 10 of a plotter 20 (medium processing device) according to the embodiment of the present invention, and meanwhile FIG. 2 is a schematic view showing the plotter 20 according to an embodiment of the present invention. As shown in FIG. 1 and FIG. 2, the plotter 20 for both drawing operation and cutting operation, which executes a drawing process and a cutting process for a target medium, includes a head 10. Then, the head 10 includes a cutter 1 (first processing means), a pen 2 (second processing means), a cutter holder 3, a pen holder 4, and a carriage 5 (holding means). In the plotter 20, the head 10 is placed at a position facing a receiving portion 8 (supporting means) including a cutter receiving portion 6 (first supporting portion) and a pen receiving portion 7 (second supporting portion).

The plotter 20 processes the target medium, by means of reciprocating the head 10 on the target medium, which is transferred while being supported with a supporting table (not shown), in a direction intersecting a direction of the transfer motion. The head 10 scans on the target medium in parallel with a longitudinal direction of the plotter 20 shown in FIG. 2, and in the meantime, the target medium is transferred in a direction intersecting a direction of the scanning motion of the head 10. The target medium to be processed by the plotter 20 is preferably a sheet medium, since it is processed while moving for transfer in the plotter 20. For example, the target medium may be a medium made of paper, and like that. Incidentally, examples of a medium targeted by the medium processing device according to the present invention include; paper for a paper pattern, paper for a cardboard, and like that, as well as a resin board, and so on. The present embodiment is explained by using a case for example, in which a paper medium (cloth material: not shown) is used as the target medium.

As shown in FIG. 1, the head 10 is reciprocated in a scanning direction shown as an arrow 'A', at a position facing paper being transferred, in the plotter 20. The paper as a target medium is so transferred as to pass through a space between the receiving portion 8 and the cutter 1 as well as the pen 2. Incidentally, FIG. 1 shows a situation of a section around the head 10 not transferring the paper, as a matter of convenience for explanation. In the head 10, the carriage 5 holds the cutter 1 and the pen 2 by way of the cutter holder 3 and the pen holder 4, respectively.

The cutter holder 3 is installed in the carriage 5 in such a way that a distance of the cutter 1 to the paper can be changed by bringing the cutter 1 close to the paper or away from the same. Then, the distance can be changed by a distance changing means (not shown). By means of changing the distance of the cutter 1 to the paper, the cutting process can be controlled while the cutter 1 being brought close to the paper, pressed against the paper to cut it, and brought away from the paper in order to stop cutting the paper. In other words, while the distance of the cutter 1 to the paper being changed by lifting and lowering the cutter 1, the cutter 1 is moved on the paper in accordance with a movement of the head 10, in such a way that the paper can be cut into a shape as required.

In a similar way, the pen holder 4 is installed in the carriage 5 in such a way that a distance of the pen 2 to the paper can be changed by bringing the pen 2 close to the paper or away from the same. Then, the distance can be changed by a distance changing means (not shown). By means of changing the distance of the pen 2 to the paper, the drawing process can be controlled while the pen 2 being brought close to the paper, pressed against the paper to draw on it, and brought away from the paper in order to stop drawing on the paper. In other words, while the distance of the pen 2 to the paper being changed by lifting and lowering the pen 2, the pen 2 is moved on the paper in accordance with a movement of the head 10, in such a way that a shape as required can be drawn on the paper.

Although the plotter 20 is explained in the present embodiment as an example of a composite device for both drawing operation and cutting operation, a device for carrying out another kind of composite processes can also be provided when other tools instead of the cutter 1 and the pen 2 are held by the carriage 5 and controlled in a similar way. Furthermore, similar processes can be executed even when positions of the cutter 1 and the pen 2 are exchanged each other in the carriage 5.

Although the pen 2 is used as a drawing means in the plotter 20, any other drawing means can be used as far as the drawing means is able to properly draw on the paper as a target medium. For example, a mechanical pencil, a colored pencil, and the like can suitably be used. In a similar way, any other cutting means may be used instead of the cutter 1 as far as the cutting means is able to properly cut the medium of paper and the like. For example, an end mill may be used for cutting a resin foam, a resin plate, and so on.

Processing by the cutter 1 and the pen 2 is supported by using the receiving portion 8. Especially, processing by the cutter 1 is supported by using the cutter receiving portion 6 in order to enable appropriate processing for the paper. The cutter receiving portion 6 is provided at a position facing the cutter 1 so as to cover a stroke range of the cutter 1 (a reciprocating stroke range of the head 10). The paper transferred in the plotter 20 contacts the cutter 1, which lowers so as to get close to the paper, at the time when the paper is passing through a space on the cutter receiving portion 6 and also just under the cutter 1. Then, the paper is cut by the cutter 1 being pressed against the paper.

In a similar way, processing by the pen 2 is supported by using the pen receiving portion 7 in order to enable appropriate processing for the paper. The pen receiving portion 7 is provided at a position facing the pen 2 so as to cover a stroke range of the pen 2 (a reciprocating stroke range of the head 10). The paper transferred in the plotter 20 contacts the pen 2, which lowers so as to get close to the paper, at the time when the paper is passing through a space on the pen receiving portion 7 and also just under the pen 2. Then, the pen 2 being pressed against the paper draws on the paper.

In the plotter 20, each of the processing by the cutter 1 and the same by the pen 2 can independently be controlled. Therefore, it becomes possible to lower the pen 2 at first onto the paper for scanning, and to lift up the pen 2 after drawing operation and lower the cutter 1 next onto the paper, and to scan the paper with the cutter 1 for cutting the paper into a shape as drawn by the pen 2. Alternatively, each tool may be operated in a way reverse to the above-described one.

Then, the carriage 5 holds the cutter 1 and the pen 2 in such a way that a distance of one tool to the paper can interchangeably be made shorter and longer in comparison with a distance of the other tool to the paper. On this occasion, the distances are changed by the distance changing means (not shown) described above. Moreover, the plotter 20 may further include a vertical position control means (not shown) for changing a distance between the carriage 5 and the paper. By a combination of changing the distance between the paper and one of the cutter 1 and the pen 2 held by the carriage 5, and changing the distance between the carriage 5 and the paper, it becomes possible to switch between the tools easily and accurately.

The cutter 1 and the pen 2 are held by the carriage 5 in such a way as to be positioned on different lines individually in the direction intersecting the paper transfer direction, namely in a scanning direction of the head 10. Therefore, the cutter 1 and the pen 2 have no chance to pass through on the same line at the time when the head 10 reciprocates.

The plotter 20 cuts the paper and draws on the paper by means of transferring the cutter 1 and the pen 2 while pressing the cutter 1 and the pen 2 against the receiving portion 8 through the intermediary of the paper. Therefore, after the cutter 1 and the pen 2 reciprocate, sometimes damage may be caused onto the receiving portion 8 owing to a pressing force of at least one of the cutter 1 and the pen 2. Under such a situation, for example when the pen 2 in drawing operation passes on the receiving portion 8 damaged by the cutter 1, hooking and the like may happen in drawing operation so that drawing accuracy becomes deteriorated.

In the plotter 20, the cutter 1 and the pen 2 have no chance to pass through on the same line at the time when the head 10 reciprocates, as described above; and therefore, without being affected by a surface condition of the receiving portion 8 after one kind of processing, the other kind of processing can be executed. More specifically, for example, the pen 2 in drawing operation does have no chance to pass on the cutter receiving portion 6 damaged by the cutter 1, and therefore the drawing accuracy of the pen 2 does not become deteriorated.

Furthermore, the cutter receiving portion 6 and the pen receiving portion 7 are provided at a position facing the cutter 1 and another position facing the pen 2, respectively, in the plotter 20. Namely, each specific part of the receiving portion 8 can be provided for each of the cutter 1 and the pen 2. Therefore, selecting an appropriate material of the receiving portion 8 for each process makes it possible to execute the process with high accuracy. In other words, each process can be executed by using the receiving portion 8 as a setting underlay, wherein the receiving portion 8 is appropriately prepared in accordance with the kind of process for which a tool is used.

For example, used as the cutter receiving portion 6 is a receiving portion including a surface made of napped material for avoiding damage being caused by the cutter 1, and meanwhile used as the pen receiving portion 7 is a rubber plate for the purpose of preventing the target medium from being damaged by the pen. In such a way, each part of the receiving portion 8 can arbitrarily be selected so as to become appropriate for each corresponding process. Thus, both the cutting operation by the cutter 1 and the drawing operation by the pen 2 can be executed with high accuracy. Furthermore, selecting a material, which is hardly damaged through each process, for the receiving portion 8 enables a reduction in replacement costs of the receiving portion 8. In the meantime, selecting a material, which is unlikely to damage each tool, for the receiving portion 8 enables a reduction in replacement costs of the tool as well.

Moreover, since the cutter receiving portion 6 is provided at a position facing the stroke range of the cutter 1 while the pen receiving portion 7 is provided at a position facing the stroke range of the pen 2, it is not needed to shift the receiving portion 8 or the tool in accordance with switching the tool. In other words, processes can be executed as required, with a simple device structure on the receiving portion 8 suitable for the processes required.

Incidentally, besides the above-described receiving portion including a surface made of napped material, any other receiving portion made of a sponge material and so on can also be used suitably as the cutter receiving portion 6. Moreover, besides the above-described rubber plate as the pen receiving portion 7, a resin sheet and the like can also be used suitably.

In the present embodiment, the plotter 20 to be used for both drawing operation and cutting operation, which is equipped with the cutter 1 and the pen 2, is explained as an example. Alternatively, the plotter may be another composite device that further includes another tool in addition to the cutter 1 and the pen 2 for executing three or more kinds of processes. In this case, each of the plurality of tools ought to be held in the carriage, while each of the tools being placed at an offset position on each specific line in the scanning direction.

Furthermore, the carriage 5 may hold the cutter 1 and the pen 2 in such a way that; either the cutter 1 or the pen 2, whichever has a greater pressing force against the paper, is positioned closer to the carriage 5 itself. In the present embodiment, since a pressing force of the cutter 1 against the paper at the time of cutting operation is greater than a pressing force of the pen 2 against the paper at the time of drawing operation, the cutter 1 and the pen 2 are provided in such a way that a distance of the cutter 1 to the carriage 5 is shorter than a distance of the pen 2 to the carriage 5. Incidentally, the carriage 5 may hold a tool expected to have a higher manufacturing accuracy, e.g., such as the cutter 1, at a closer position to the carriage 5 itself than any other tool. In this way, if a tool having a greater pressing force against the paper and a tool expected to have a higher manufacturing accuracy are held at a closer position to the carriage 5 than any other tool, it becomes possible to surely provide the tool with an intended pressing force, and therefore the process can be executed with a high accuracy.

<Appendant Matters>

As described above, in an embodiment of the plotter 20 according to the present embodiment; included are the cutter 1 and the pen 2 for individually executing each specific process for the paper being transferred in a predetermined direction, while the cutter 1 and the pen 2 being reciprocated in a direction intersecting the transfer direction of the paper; and the receiving portion 8 for supporting the paper to be processed by the cutter 1 and the pen 2, while the receiving portion 8 being provided at a position facing the cutter 1 and the pen 2 through the intermediary of the paper. Wherein the cutter 1 and the pen 2 are positioned on different lines individually in the direction intersecting the transfer direction of the paper.

According to the above-described configuration, the cutter 1 and the pen 2 are individually placed at an offset position on each specific line in the direction intersecting the transfer direction of the paper. Accordingly, the cutter 1 and the pen 2 have no chance to pass through on the same line at the time of processing the paper while being reciprocated in the direction intersecting the transfer direction of the paper. Therefore, without being affected by a surface condition of the receiving portion 8 after one kind of processing, the other kind of processing can be executed. Thus, both the processes by using the cutter 1 as well as the pen 2 can be executed with high accuracy.

Moreover, in the plotter 20, the receiving portion 8 may further includes the cutter receiving portion 6 provided at a position facing the cutter 1 through the intermediary of the paper, and the pen receiving portion 7 provided at a position facing the pen 2 through the intermediary of the paper.

According to the above-described configuration, the cutter receiving portion 6 is provided as a receiving portion for the cutter 1, and the pen receiving portion 7 is provided as a receiving portion for the pen 2; and thus each specific receiving portion can be provided for each of the cutter 1 and the pen 2. Therefore, selecting an appropriate material of the receiving portion for each process makes it possible to execute the process with high accuracy. Furthermore, since an appropriate material of the receiving portion 8 for each process is selected, durability of each tool as well as durability of the receiving portion 8 itself are improved so that replacement costs of these components can be reduced.

Moreover, in the plotter 20, preferably one of the cutter 1 and the pen 2 is for drawing on the paper, and the other is for cutting the paper. Thus, equipped are the pen 2 for drawing on the paper and the cutter 1 for cutting the paper. Then, since these means are held by the carriage individually at each offset position, for example, drawing operation by the pen 2 is not affected by a surface condition of the receiving portion 8 after cutting operation by the cutter 1. Therefore, both the drawing operation and the cutting operation can be executed with high accuracy.

Moreover, preferably the plotter 20 further includes the carriage 5 for holding the cutter 1 and the pen 2; and preferably the carriage 5 holds the cutter 1 and the pen 2 in such a way that a distance of one tool to the paper can interchangeably be made shorter and longer in comparison with a distance of the other tool to the paper.

According to the above-described configuration; while two kinds of tools being held collectively, one tool for executing an objective process can be brought close to the paper for executing the process. Namely, it is not needed to change the tool for each process, and the device does not need to stop operation for changing the tool, so that the processing time can be shortened. Furthermore, since the distances of the tools to the paper are changed by using one carriage, positions of the tools in relation to the paper can easily be adjusted.

Moreover, in the plotter 20, preferably the carriage 5 holds either the cutter 1 or the pen 2, whichever has a greater pressing force against the paper, at a position closer to the carriage 5. In this case, the cutter 1 has a greater pressing force against the paper than the pen 2 has, and therefore the carriage 5 holds the cutter 1 and the pen 2 in such a way that a distance of the cutter 1 to the carriage 5 is shorter than a distance of the pen 2 to the carriage 5. Thus, each tool can have a pressing force as required for sure, and each process can be executed with high accuracy.

The present invention is not limited to the embodiment described above, and various modifications can be made within scopes described in the claims. In other words, any other embodiment achieved on the basis of combination of technical means arbitrarily modified within the scopes described in the claims is also included in the technical scope of the present invention.

INDUSTRIAL APPLICABILITY

The present invention can be used for various kinds of medium processing devices, wherein each of the medium processing devices executes at least two kinds of processes for a medium.

What is claimed is:

1. A medium processing device comprising:

a first processing means and a second processing means for individually executing each specific process for a medium being transferred in a predetermined direction, while the first processing means and the second processing means being reciprocated in a direction intersecting the transfer direction of the medium; and a supporting means for supporting the medium to be processed by the first processing means and the second processing means, while the supporting means being provided at a position facing the first processing means and the second processing means through the intermediary of the medium;

wherein the first processing means and the second processing means are positioned on different lines individually in the direction intersecting the transfer direction of the medium.

2. The medium processing device according to claim 1, wherein the supporting means further includes:

a first supporting portion provided at a position facing the first processing means through the intermediary of the medium; and a second supporting portion provided at a position facing the second processing means through the intermediary of the medium.

3. The medium processing device according to claim 1, wherein one of the first processing means and the second processing means is a means for drawing on the medium, and the other is a means for cutting the medium.

4. The medium processing device according to claim 1, wherein the medium processing device further comprises a holding means for holding the first processing means and the second processing means; and the holding means holds the first processing means and the second processing means in such a way that a distance of one processing means to the medium can interchangeably be made shorter and longer in comparison with a distance of the other processing means to the medium.

5. The medium processing device according to claim 4, wherein the holding means holds either the first processing means or the second processing means, whichever has a greater pressing force against the medium, at a position closer to the holding means.

* * * * *